United States Patent [19]

Barrus et al.

[11] 3,941,051

[45] Mar. 2, 1976

[54] PRINTER SYSTEM

[75] Inventors: Gordon B. Barrus, El Segundo; Leo J. Emenaker, Playa del Rey; Raymond F. Melissa, Inglewood, all of Calif.

[73] Assignee: Printronix, Inc., Irvine, Calif.

[22] Filed: Aug. 8, 1974

[21] Appl. No.: 495,830

[52] U.S. Cl. ..... 101/93.04; 197/1 R

[51] Int. Cl.[2] ..... B41J 5/08

[58] Field of Search..... 101/93.03, 93.04, 93.05, 101/93.41; 197/1 R, 139

[56] References Cited

UNITED STATES PATENTS

| | | | |
|---|---|---|---|
| 3,280,738 | 10/1966 | Goodrich | 101/269 |
| 3,420,352 | 1/1969 | Moran | 197/133 |
| 3,768,403 | 10/1973 | Rose | 101/93.04 |
| 3,782,278 | 1/1974 | Barnett | 101/93.04 |
| 3,810,195 | 5/1974 | Kilroy | 101/93.04 X |

*Primary Examiner*—Harland S. Skogquist
*Attorney, Agent, or Firm*—Fraser and Bogucki

[57] ABSTRACT

A dot matrix printer system utilizes a reciprocating shuttle having a plurality of hammer elements and externally energized hammer controls mounted with the hammers on the shuttle. Each hammer scans a number of dot printing positions within a dot matrix line, and is energized at a high repetition rate during movement to imprint serially the dot patterns in that line for several successive characters. The paper is then advanced and the next dot matrix line is printed in the reverse direction. The shuttle mechanism forms a part of a dynamically balanced system, being in one example driven in a trapezoidal motion from a cam system that also engages an oppositely moving counterweight system. A highly reliable fast acting hammer bank comprises an array of individual spring hammer elements and associated magnetic actuators, the hammer elements normally being magnetically biased to a retract position by a permanent magnet. The magnetic field is neutralized to permit hammer flight with controlled velocity for imprinting, with hammer return being automatically achieved by the magnetic bias. The system is amenable to generation of a wide variety of dot matrices and arbitrary printing patterns, and provides uniform and well defined characters through a substantial number of copies, but nevertheless operates reliably and at high speed with a low cost mechanism that does not require adjustment.

48 Claims, 9 Drawing Figures

FUNCTIONAL BLOCK DIAGRAM

PRINTER SYSTEM

BACKGROUND OF THE INVENTION

This invention relates to mechanical printers, and more specifically relates to character printing mechanisms of the dot matrix type.

Mechanical printing systems for the data processing industry, particularly those known as line printers, have generally employed formed character images on a member which is moved relative to the paper so as to present a desired type position for an impacting action between the character image and paper. In order to achieve higher speeds, line printers in the recent past have typically employed rotating drums which move vertically with respect to the paper, or a character belt or chain which has horizontal motion with respect to the paper. The character bearing member typically moved in front of the paper, while one or a number of hammers disposed behind the paper abruptly impact the paper against the character member at the proper time. Such printers are the most widely used computer and data system output printing devices, giving print rates of approximately 300 lines per minute and greater. With the virtually constant reduction in the electronic part of system costs over a period of time, however, such printers have become disproportionate in cost, particularly for many lower cost main frame and minicomputer applications.

In addition, the moving character types of systems require extensive maintenance or precise and costly fabrication, to maintain accurate character registration and to minimize image smearing in the direction of character motion. Inherently, such systems cannot accommodate large character sets or variable type fonts, at least without extensive component replacement. They further impose certain limitations on print quality because it is not economically feasible to vary the hammer force, with the result that the intensity of the printed character tends to vary with the area of the raised surface.

More recently, wire matrix printers have been introduced for use with data processing systems, to operate at speeds typically in the range of 50 to 100 lines per minute, and in some instances up to 200 lines per minute. In many of these wire matrix printers, a printer head is used that has a number of separately actuable print wires, one for each possible vertical position within the matrix. The printer matrix head is moved across the front of the paper on a carriage, forming successive characters in a line by impacting against a ribbon which bears against the paper in matrix configurations which define different characters. This technique has substantially reduced costs, particularly for lower speed applications, while permitting a substantial increase in the number of characters in a character set. However, such systems have performance and reliability limitations when operated at high rates for substantial periods of time because of the high rate of usage of the individual printing elements. In addition, such systems have speed limitations, and typically cannot operate at approximately 300 lines per minute or greater. Furthermore, the dot matrix pattern is predetermined by the print head that is used, so that the number and relative disposition of the vertical dot matrix positions cannot readily be changed.

In an attempt to overcome some of these limitations of the dot matrix printers, a movable hammer bank has been devised for a line printer as evidenced by U.S. Pat. No. 3,782,278. In this system, a flexible sheet of hammers, one for each character position, is disposed along a line, and then horizontally stepped across the width of one character with each hammer forming the dots for one character position on that horizontal pass. The paper is then incremented vertically one dot row or line to allow printing of the dots for the next horizontal pass, continuing until the entire character is printed. This system enables line printing with greater speed and without substantial increase in cost, but has a number of disadvantages. To actuate the hammers, stationary hammer actuating mechanisms are disposed adjacent the hammer elements, which are normally in a neutral position and must have adequate clearance. The hammer actuating mechanisms are magnetic, and the clearances needed between the pole pieces of the actuating mechanisms and the hammer introduce substantial air gaps in the flux path, and therefore substantially lower efficiency. The system has certain speed limitations, inasmuch as the movable hammer mechanisms must be incremented laterally to a new position, retracted from the neutral position, fired to imprint, then allowed to settle or dampen at the neutral position before recycling can begin. The incrementing motion of the hammer system relative to the fixed actuators both predetermines and limits the number of matrix patterns that may be imprinted.

There is therefore a general need for a dot matrix system of higher speed but lower cost than has heretofore been available, particularly for line printers. Such a system preferably should have capability for virtually arbitrary selection of dot matrix configurations, type fonts, character sets, and nature of the imprinted data, whether typewriter quality characters, Katakana (simplified Japanese), upper and lower case characters or graphical information are imprinted.

SUMMARY OF THE INVENTION

Dot matrix printers in accordance with the invention comprise a hammer bank and actuating system mounted on a reciprocating shuttle mechanism, the hammers being actuated concurrently to imprint on the fly during reciprocating motion. Each hammer serially generates the dot patterns for one dot line of a sequence of characters during each forward and reverse movement. The hammer elements are preferably magnetic elements forming part of a substantially closed magnetic path when the hammer is retracted. This arrangement has relatively few moving parts and provides line printing with high speed and reliability but at low cost.

In a specific example of a line printer in accordance with the invention, the high speed hammer bank system comprises common magnetic bias and magnetic return path elements mounted in magnetic circuit with a plurality of elongated magnetic spring hammer elements, each of which has a dot imprinting protrusion in facing relation to a printing line position. The hammer bank system is driven by a cam system providing, in this particular example, a trapezoidal type of reciprocating motion in which there is substantially constant velocity across a selected lateral distance in each of the forward and reverse directions, and a substantially constant change of velocity during motion reversals. A matching counterweight system is also coupled to be driven by the cam mechanism providing a dynamically balanced system. The hammer elements are mechanically secured in the hammer bank assembly at one end, and have a free end that is normally attracted to a facing pole tip by the magnetic field established by the permanent magnet, the hammer being the only movable element. The instantaneous position of the hammer bank is sensed at an encoder wheel coupled in the cam drive system, to provide positional references for firing the hammers such that the dots are imprinted on the paper at precise dot matrix positions. Each hammer spring element is normally retracted to a spring loaded position by the magnetic bias, and is set in flight by energization of a coil mounted in the pole tip region, which establishes a magnetic field opposing the field of the permanent magnet. The hammers fly at velocities determined by the virtually constant spring characteristics to imprint upon the paper, being quickly returned to the retract position. Cycle times for the hammers are so fast that a 300 line per minute rate is readily attained with a 9 × 7 dot matrix configuration, with freedom from smearing, nonuniformity and character distortion.

Hammer mechanisms in accordance with the invention have particular advantages for imprinting systems. In a particular example, the magnetic path shunting the hammers is in a generally C-shaped configuration, with the pole tip facing the free end of the hammer element being tapered at the air gap region, and the coil being disposed adjacent the pole tip, thus providing maximum field efficiency. A damping element is disposed between the base of the hammer and the facing portion of the hammer, in the region of initial curvature of the hammer from the fixed base region. The rebound action of the hammer is thereby damaged, further decreasing cycle time. The hammer impact point is the center of percussion, providing most efficient transfer of energy. The spring hammer is operated well within its elastic limit and therefore has long life.

Further in accordance with the invention, the magnetic path and the permanent magnet may comprise a single magnetic return member and a single permanent magnet, and the hammer bank may be fabricated on a unitary basis as a number of frets extending from a common base. Also, the base portion of the hammer bank and actuating system, in the region of the fixed end of the hammer elements, is precompassed by tie rods which not only unify the structure but give greatest strength to the permanent magnet. Thus the hammer bank is readily and simply fabricated and once fabricated is virtually free from the need for adjustment.

Another aspect of the invention relates to the shuttle drive and reciprocating motion mechanism. The shuttle mechanism is reciprocated at high speed under control of a relatively small constant speed motor, coupled to a flywheel and encoder which provides desired positional reference information. The shaft from the flywheel system rotates a double lobed cam configured to provide the desired reciprocating motion, such as the trapezoidal characteristic previously mentioned. The counterbalanced shuttle mechanism is substantially free of unwanted vibrations and system resonances. Relatively large increments of movement may be sensed at the encoder wheel to denote very small increments at the printing mechanism. Thus, combining the predictable and controlled motion of the shuttle mechanism and the precisely controlled flight time of the hammer mechanisms, timing signals derived from the positional encoder enable the generation of precise dot matrix patterns at the character positions. Only the dot timing signals and the line incrementing distances need be changed to change the dot matrix pattern, and therefore there is virtually arbitrary control over type fonts, character sizes and the types of characters and data that may be imprinted.

Another feature of systems in accordance with the invention provides a firm and uniform imprinting base upon which the dot printing elements may impact, irrespective of the number of copies being made and the lateral movement of the imprinters relative to the paper. On the opposite side of the printing line position from the hammer bank is disposed a platen whose surface is translatable in the direction toward and away from the hammer elements. In a specific example this platen comprises an eccentrically mounted cylinder providing a backing surface for the paper. A plurality of substantially flat finger elements disposed on the upstream side of the paper from the printing line position urges the paper against the platen, ironing out air bubbles, flattening the paper and holding it under tension, for clean and uniform imprinting by the flying dot printer elements.

In accordance with other aspects of the invention, the shuttle mechanism is linearly reciprocated along an offset axis in linear bearings mounted on the frame structure. The shuttle mechanism includes a front face cover that bears against the ink ribbon moving between the facing web and the print hammers, and incorporates apertures through which the dot imprinting elements extend only when printing. The shuttle mechanism may be pivoted about its mounting in a direction away from the paper, to facilitate paper loading through the system.

BRIEF DESCRIPTION OF THE DRAWINGS

A better understanding of the invention may be had by reference to the following description, taken in conjunction with the accompanying drawings, in which.

DETAILED DESCRIPTION OF THE INVENTION

Figure 1:
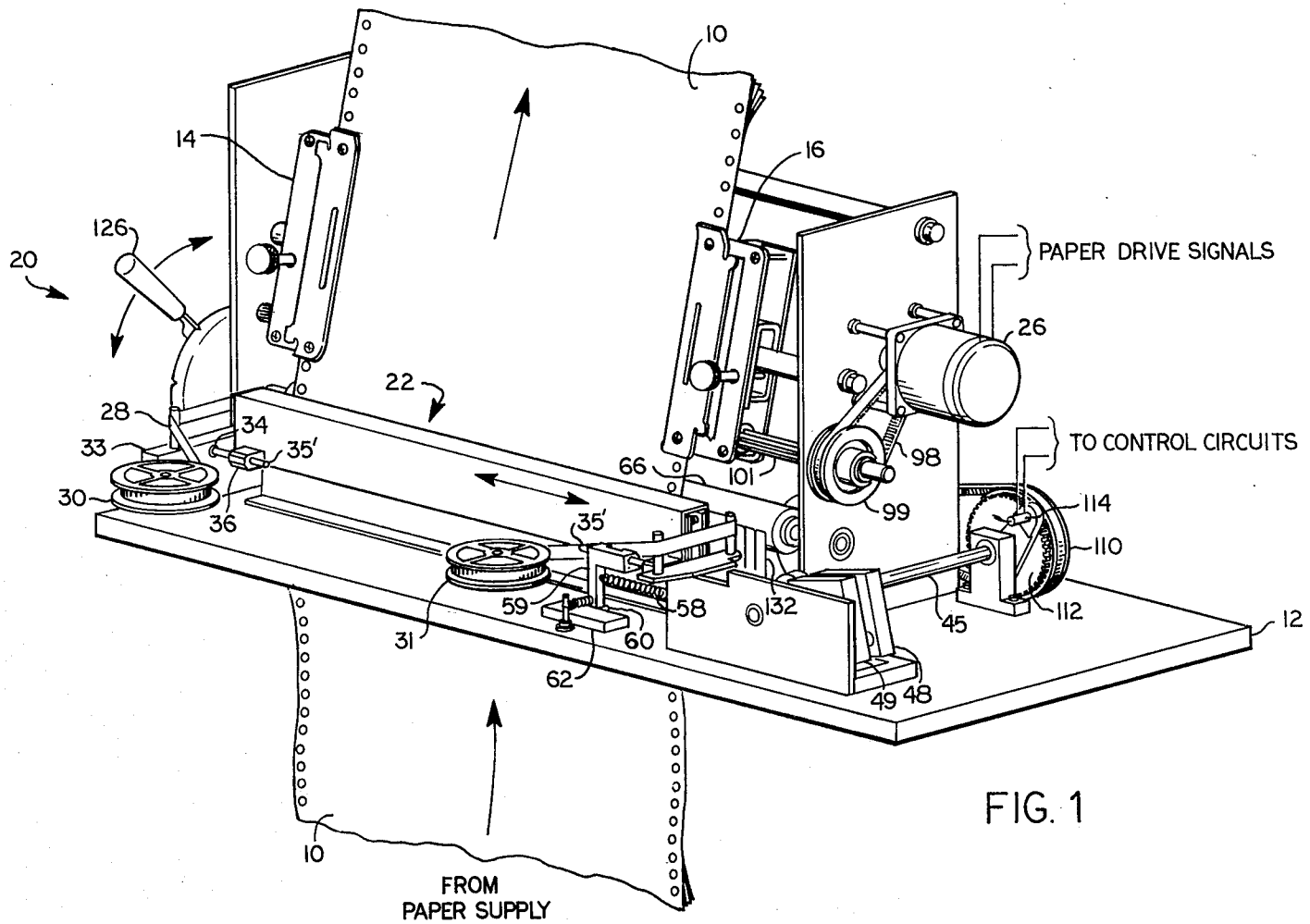
FIG. 1 is a perspective view, partially broken away, of the principal mechanical elements of a printer system in accordance with the invention.
Figure 2:
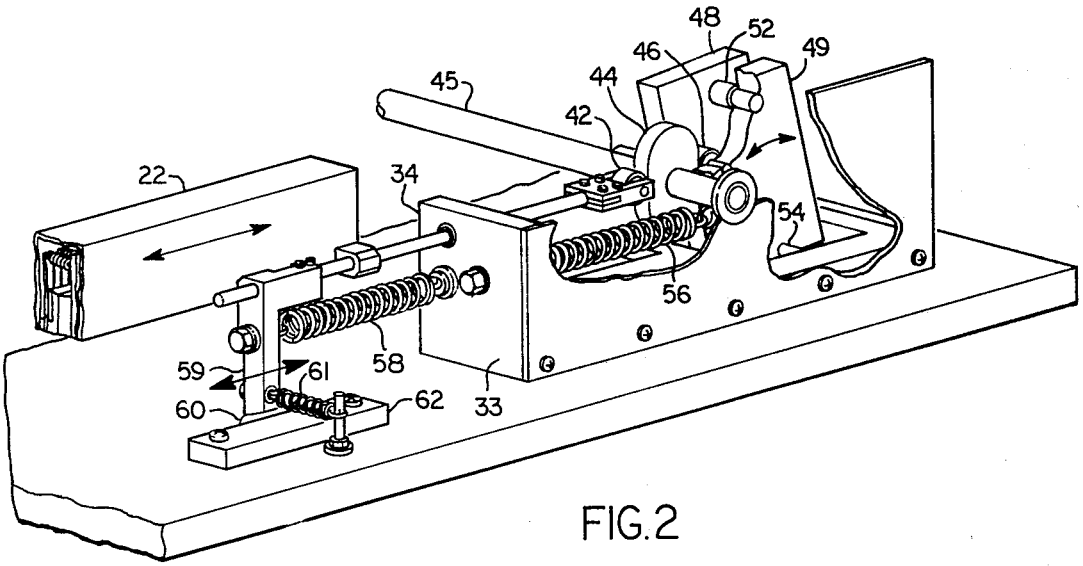
FIG. 2 is a fragmentary perspective view, partially broken away, of a portion of the shuttle mechanism and cam drive mechanism utilized in the arrangement of FIG. 1.

An example of a printer in accordance with the invention comprises a 132 column page printer for data processing systems, operating typically at about 300 lines per minute and printing an original and a substantial number (e.g. five) of clear carbon copies. The principal mechanical elements of the printer are shown in FIGS. 1 and 2, with other mechanical elements being depicted in more detail in FIGS. 3–8, and an exemplary electronic data transfer and processing system being shown in FIG. 9. Conventional details such as paper supply takeup mechanisms, an external housing, and similar features have been omitted or simplified for clarity and brevity. The printer may be mounted as a free-standing unit, as a desk supported unit, or may be otherwise configured.

Referring now specifically to FIGS. 1 and 2, the paper to be imprinted comprises one or a number (here six, by way of example) of webs 10 of conventional edge perforated, continuous or fan folded sheet fed upwardly through a base frame 12 and past a horizontal printing line position at which printing takes place. The original and carbon sheets are advanced together past the printing line by known tractor type drives 14, 16, engaging the edge sprocket perforations along the two margins of the paper. Just below the printing line, the webs 10 are held flat, under controlled tension and in registration, without entrapped air pockets, against the platen 66, by a paper thickness adjustment control 20 described below in conjunction with FIGS. 4, 7 and 8. At the printing line, a shuttle mechanism 22 mounting a plurality of print hammers 24 spaced apart along the printing line is horizontally reciprocated to span a desired number of character column positions. This example assumes that there are to be 132 character positions or columns across the paper 10, and a bank of 44 hammers 24 is employed, with the lateral travel thus being sufficiently wide (0.3 inches in this example) for each hammer to move across three different adjacent columns. Both 5 × 7 and 9 × 7 dot matrices are now widely used to define characters in dot printing systems; the description of the present system is based upon a 9 × 7 dot matrix but may use virtually any matrix, and may in fact interchange between different matrices. The hammers 24 are operated concurrently during the shuttle 22 motion to write selectively spaced dots within a horizontal dot matrix line in each of the three associated columns for each hammer. The paper 10 is then advanced by a stepping motor 26 to the next horizontal dot matrix line position. Thus the system concurrently writes different character segments in serial dot row fashion, first in one direction and then in the other.

At the printing line position, a ribbon 28 is interposed between the hammer 24 bank and the paper 10, the ribbon 28 being advanced by any suitable means, such as the supply and takeup reels 30, 31 shown, or a ribbon carriage supply and drive.

Figure 3:
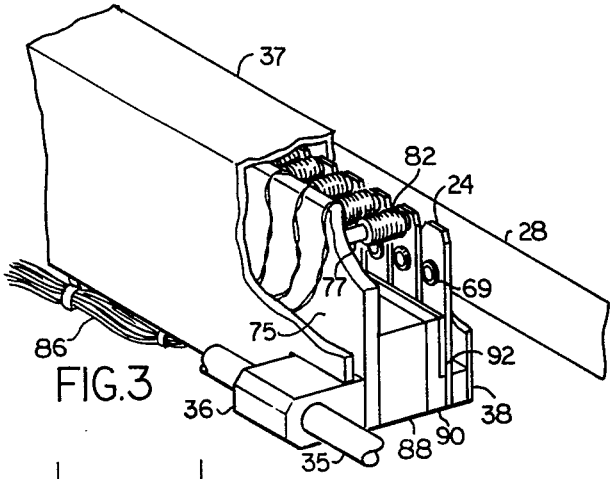
FIG. 3 is a perspective view, partially broken away, of a portion of a hammer bank assembly employed in the arrangement of FIG. 2.
Figure 5:
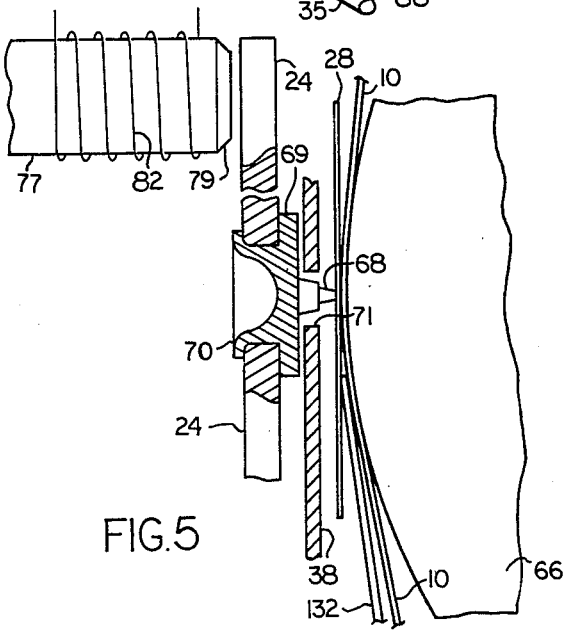
FIG. 5 is an enlarged fragmentary view of a portion of the hammer and associated elements utilized in the arrangement of FIGS. 3 and 4.
Figure 4:
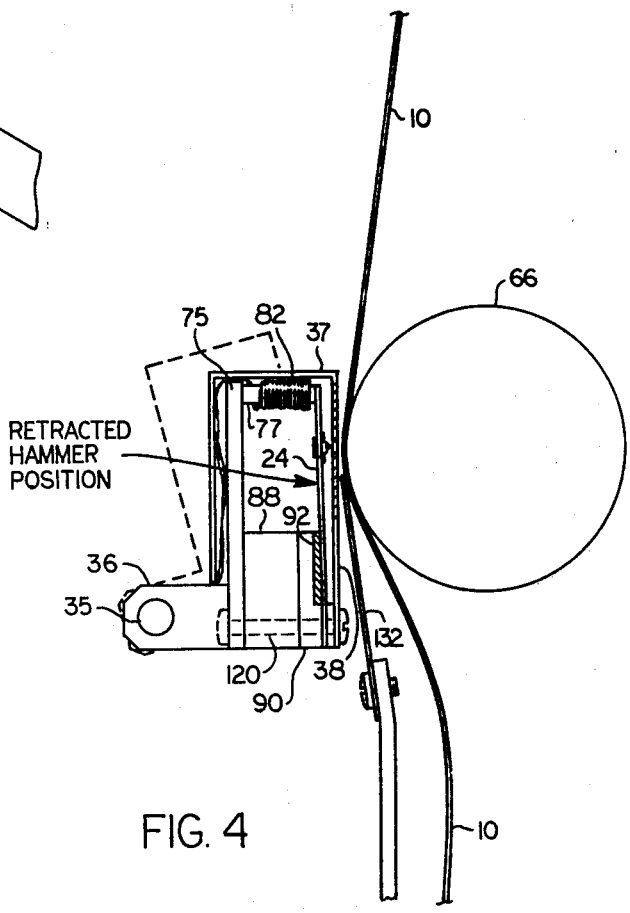
FIG. 4 is a side view of a portion of the shuttle mechanism and platen assembly.
Figure 6:
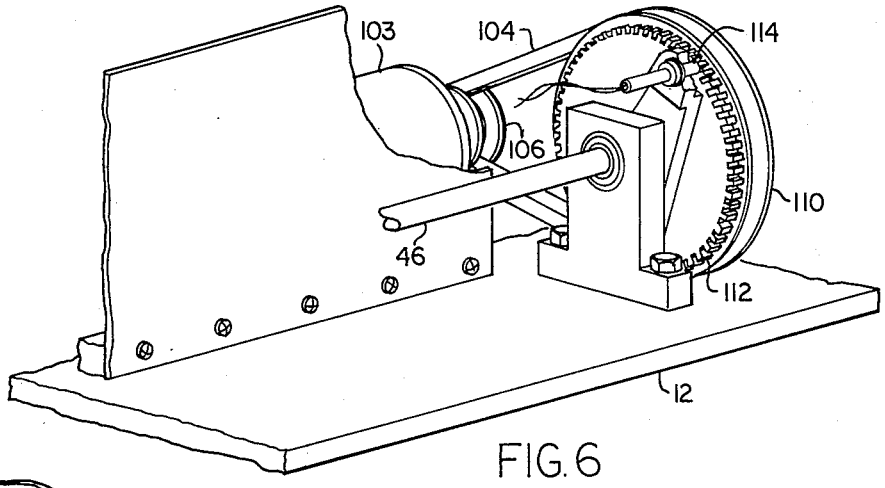
FIG. 6 is a fragmentary perspective view of another part of the shuttle mechanism drive system.

Details of the shuttling hammer bank mechanism are best seen in FIGS. 2–4. Vertical shuttle support elements 33 mounted on the base frame 12 include linear bearings 34 for receiving horizontal support shafts 35, 35′. The shafts 34, 35′ are coupled by brackets 36 to a horizontal channel member defining a shuttle mechanism cover 37 extending along the printing line position. The cover, as best seen in FIGS. 3, 4 and 5, includes a front face 38 on the side opposing the ink ribbon 28 and the adjustable paper control 20. Thus the support shafts 35, 35′ provide an off-axis reciprocable support for the shuttle mechanism 22.

To reciprocate the shuttle mechanism 22, a force-balanced cam drive 40 is mounted adjacent to one end of one support shaft 35. A rotatable cam follower 42, mounted as a terminus for the shaft 35, engages the periphery of a double lobed cam 44 which is rotated by a shaft 45 coupled to a flywheel and drive system described hereafter. On the opposite side of the cam 44 from the first cam follower 42, and in axial alignment therewith, a second rotatable cam follower 46 also engages the cam 44 periphery. The second cam follower 46 is mounted within a counterweight structure defined here by a pair of spaced apart counterweight blocks 48, 49 joined together by a spacer 52 and rotating about a shaft 54 coupled to the frame 12 and lying along an axis substantially parallel to the cam shaft 46 axis. A spring 56 coupling the counterweights 48, 49 to the frame 12 biases the second cam follower 46 into constant engagement with the cam 44. The shuttle mechanism 22 and the first cam follower 42 are similarly continuously biased against the cam 44 by a spring 58 coupling a depending bracket 59 to a fixed part of the frame 12, here the shuttle support 33. It will be evident to those skilled in the art that many other arrangements may be utilized, including compression spring as well as tension spring arrangements, or that a direct spring coupling may be used between the shuttle mechanism 22 and the counterweight system.

For ease of feeding the webs 10 past the printing line position, the shuttle mechanism 22 is pivotally rotatable about the off-axis support shafts 35, 35′ at the brackets 36. However, the shuttle mechanism 22 is normally held at its printing position under the force exerted by a tension spring 61 coupling the depending bracket 59 on the shaft to the frame 12. A limit stop position for the bracket 59 is defined by engagement of a friction bearing element 60 against a linear surface defined by a reference member 62 mounted on the frame 12. The entire shuttle mechanism 22 can therefore be pivoted about the axis of the shafts 35, 35′ away from the printing line position so as to provide greater clearance between the hammer tips and the facing paper control mechanism 20, for passage of the paper 10.

The arrangement of the hammers 24 in the hammer bank is best seen in FIGS. 3, 4 and 5. The hammers 24 are elongated, resilient magnetic spring elements mounted at a lower fixed end in spaced apart relation along a horizontal axis, with each of the hammers being vertically disposed (in the orientation of this example) and terminating in a movable free end. The hammers 24 are of magnetic material of 0.032 inch thickness, and each lies approximately tangential to a platen 66 disposed on the opposite side of the paper 10 and providing a backing support for receiving the impact of the hammers. Each hammer 24 includes a dot matrix printing tip 68 extending normal from the surface of the hammer 24 in the direction toward the ribbon 28 and paper 10. The tip 68 is suitably small for the chosen matrix, being of 0.016 inch diameter in this example. The tips 68 of the successive hammers 24 lie along a selected horizontal line substantially radial to the adjacent arc of the curved surface of the platen and defining the printing line position. When retracted, each tip 68 is disposed slightly behind the front face 38 of the shuttle cover 37, as best seen in FIG. 4. The dot matrix printing tip 68 is a wear resistant wire or hardened tool steel element which may be affixed by various means to the hammer 24. A convenient mounting is depicted in FIG. 5, in which the tip 68 is integral or secured to a base disk 69 having an outwardly directed flange portion relative to the tip, with the flange 70 being curved about the inner surface defining an aperture in the hammer 24, so as to rivet the base disk 69 and coupled hammer tip 68 to the hammer 24. Preferably, the tip 68 is mounted at that longitudinal position along the length of the hammer 24 that defines the center of percussion of the hammer 24. When impacting, as in the position of FIG. 5, the tip 68 alone extends through an aperture 71 in the cover face 38.

In the hammer bank, referring again to FIGS. 3 and 4, a planar common return member 75 is mounted in parallel, spaced apart relation to the hammers 24 on the opposite side from the hammer tips 68. Individual pole pieces 77 having tapered pole tips 79 extend outwardly from the common return member 75 into close juxtaposition to the different individual hammers 24. Each hammer 24 is in contact and in magnetic circuit with the adjacent magnetic pole piece 77 when in the retract position. Energizing coils 82 are individually wound about each of the pole pieces 77, adjacent the tapered pole tip 79, with leads from the coils conveniently being joined to terminals and printed circuit conductors (not shown in detail) on the common return member 75. External conductors to associated circuits are physically coupled together in a harness 86 extending outwardly from the shuttle mechanism 22 to the associated driving circuits. The harness 86 reciprocates along its length with the motion of the shuttle mechanism 22.

The magnetic circuit in the hammer bank also includes a common permanent magnet 88 of elongated bar form, disposed between the common return member 75 and a magnetic insert 90 which abuts the fixed bottom end of each hammer 24. The magnetic insert has an offset upper portion in which is disposed a resilient damping element 92, such as butyl rubber, abutting the hammer surface immediately above the fixed region but not impeding the curvature in the retract position.

The hammer bank operates by individually releasing the spring hammers 24 from a retract position in which the hammers 24 are held against the facing pole tip 79. A closed loop magnetic path is normally defined by the permanent magnet 88, common return member 75, individual pole piece 77, the hammer 24 itself, and the insert 90. When retracted, the hammer is held with the tip 68 out of engagement with the ribbon 28 and is slightly behind the cover front face 38 as previously described. The moving ink ribbon 28 therefore bears against the front face 38 and does not slide with any substantial frictional force against the paper 10. When a given coil 82 is energized, however, the magnetic field in the individual circuit is neutralized adjacent the free end of the hammer, and the hammer 24 is released. The spring effect of the hammer 24 causes it to fly with a predetermined velocity and flight time to impact the tip 68 against the ribbon 28 and underlying paper 10. The motion and force are both predictable and controllable, inasmuch as they result only from the constant spring characteristic of the hammer 24 and the distance of its flight. Variations in printing intensity may be introduced by varying the time of termination of the energizing pulses, and thus the time of regeneration of the restoring force exerted by the permanent magnetic field. Usually, however, the field cancelling pulse is terminated in coincidence with the impact time. In the practical example being described, the complete cycle time is 1 millisecond, i.e., the hammer is ready to cycle again after 1 millisecond, having impacted the paper, returned to the retract position, and settled to a static condition.

This high speed motion of the individual hammers 24 within the hammer bank is effectively employed with the continuous reciprocating motion of the shuttle mechanism 22. As the cam drive 40 of FIG. 2 operates, the cam follower 42 generates, with the double lobed cam configuration shown, a trapezoidal motion in the shuttle mechanism 22. That is, the shuttle mechanism operates at substantially constant speed (i.e., 14 ips) for a given duration in one direction, and changes velocity at a substantially constant rate until it is reciprocated in the opposite direction, again at a substantially constant speed, and so forth. In each of the substantially constant speed motions, successive dots for each of three characters are imprinted serially along the given dot printing positions for that horizontal line of a character. Constant speed motion is not required inasmuch as sinusoidal and other motions can be used, but facilitates timing of the dot column positions within each character dot matrix.

Figure 9:
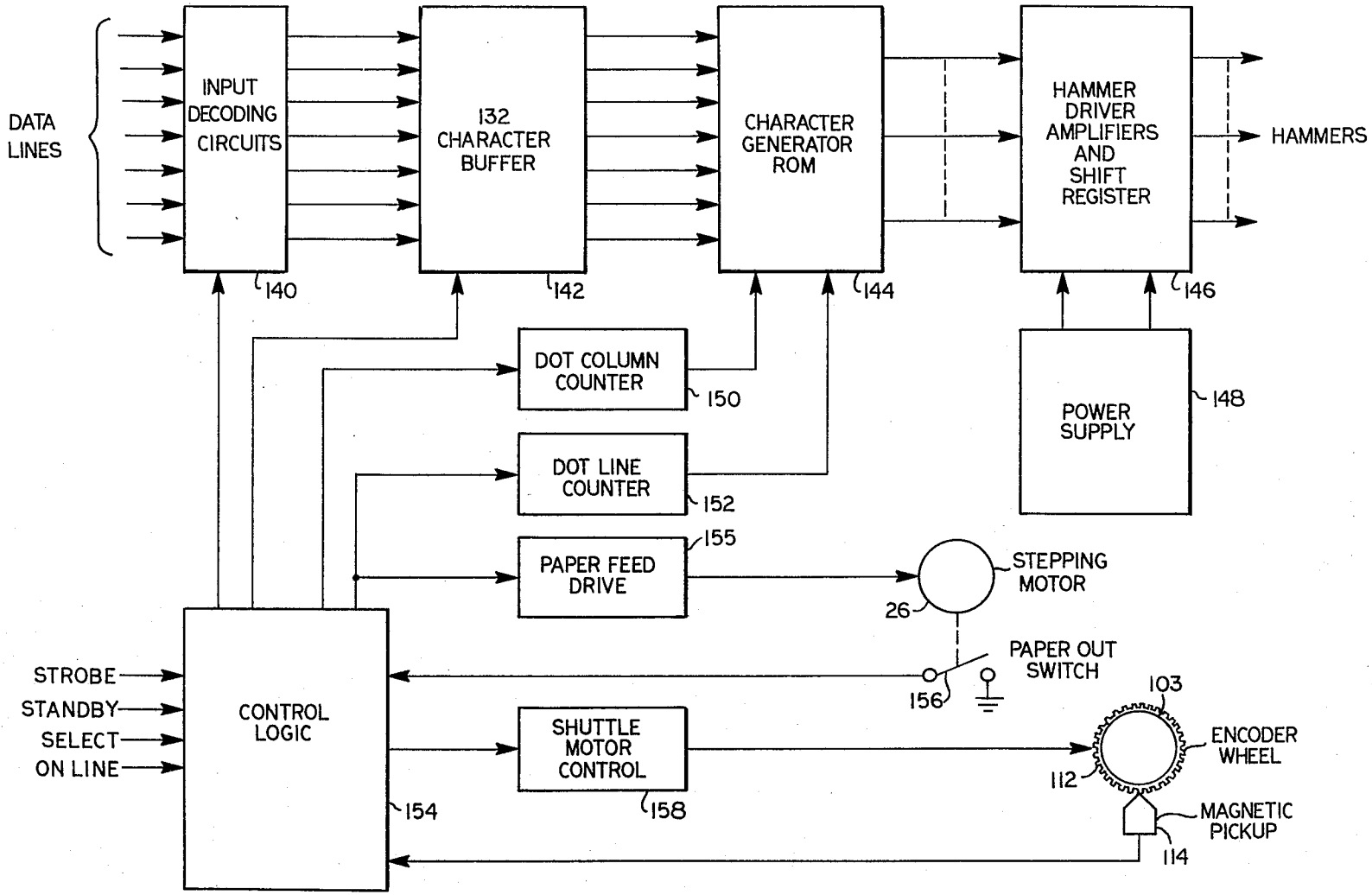
FIG. 9 is a simplified block diagram of an electronic control system that may be used in conjunction with systems in accordance with the invention.

The paper drive system is best seen in FIG. 1, and comprises the paper drive stepping motor 26, receiving individual incrementing pulses from the associated control system, described hereafter in conjunction with FIG. 9, and a drive mechanism including a belt 98 and driven pulley 99 together with a splined drive shaft 101 for the tractor drives 14, 16. Further details of this otherwise conventional drive mechanism need not be elucidated. The drive system for the shuttle mechanism 22, seen in FIGS. 1 and 6, comprises an AC drive motor 103 coupled by a drive belt 104 and pulley 106 to drive a flywheel 110 to which is coupled a toothed encoder wheel 112. A magnetic pickup head 114 is disposed in close association to the toothed periphery of the encoder wheel 112, to provide positional signals to the associated circuits. A special indicia, such as an extra gap, may be provided as a "home" or reference position.

The drive system and positional encoder mechanism provide substantially constant speed motion of the shuttle mechanism 22 in the forward and reverse directions, and the substantially constant change of velocity between directions minimizes the time required for reversal of direction. The flywheel 110 adds a substantial mass into the dynamic system, permitting usage of a smaller motor than would otherwise be needed, and minimizing the tendency of the system to introduce a slight velocity change in the constant velocity portions of the motion, due to the differential effect of operating against a rising or falling cam surface.

The presence of the counterweight mechanism in the shuttle drive maintains the entire system in dynamic balance, and virtually no vibration can be felt at the base frame 12. Consequently, system resonances and motions set up by other vibrations do not disturb the precise placement of the printed dots within the matrices. Adequate accuracy for dot position reference is obtained by the large encoder wheel 112 coupled into the drive system. Despite the fact that the dot registration pattern in the matrix is very small (e.g. 0.01 inch) and despite the fact that dot placement must be precise in order to avoid character distortion, a relatively large tooth encoder wheel, having approximately 200 teeth on a 20 inch circumference, is employed in this example. The large circumference of the encoder wheel 112 is greatly multiplied with respect to the translation of the shuttle mechanism 22, and a given arc of movement of the drive system and encoder wheel 112 is reduced to a much smaller reciprocating movement of the shuttle mechanism through operation of the cam drive 40. Specifically, for each one-fourth rotation of the encoder wheel 112, there is only a 0.3 inch traversal for the shuttle mechanism 22, so that the encoder wheel 112 therefore has adequate resolution to define the successive dot matrix positions along a line.

The printer system as heretofore described can operate as a line printer for a data processing system with significant advantages in terms of cost, complexity, and print quality through a number of carbons. The printed copies are free from tendency to smear and variations in intensity of printed characters. The system does not require adjustments to compensate for wear or dissimilar operation of different hammers in the hammer bank. Because the magnetic actuating system for each of the hammers moves with the hammer bank, and because the hammer 24 is a part of the magnetic circuit itself, there are neither substantial variations in the magnetic circuit nor substantial losses. Because the hammers 24 operate on the stored energy principle, being released from the retracted position only when the energizing circuit is actuated, the flight time and impact force are determined solely by the invariant spring characteristic of the hammer itself. Consequently, only the simple and reliable hammer spring mechanism affects the resulting imprint, and the system requires virtually no individual adjustments.

This arrangement of a shuttling hammer bank has further attractive features for system users. A 9 × 7 dot matrix (9 horizontal and 7 vertical dots) affords a superior combination of print quality and speed. However, it will be evident to those skilled in the art that a simpler 5 × 7 or a much more detailed matrix may be utilized alternatively, simply by adjusting the vertical incrementing distance and changing the horizontal dot matrix positions by utilizing a different resolution on the encoder wheel 112. The 9 × 7 matrix is readily achieved by using only 5 horizontal timing divisions, and electronically inserting half steps between them through the use of delay circuit elements. This result is feasible because of the arbitrary writing capability of the hammers, which also permits writing of a solid line if desired. It will also be understood by those skilled in the art that a combination encoder wheel providing a number of incremental resolutions may be utilized, and that this may be an optical device or a magnetic device of the type shown. By utilizing a higher dot resolution in the printing matrix, it is of course feasible to generate typewriter quality print, upper and lower case characters and Katakana characters. Thus only simple changes of the incrementing distances and positional reference information need be utilized, in conjunction with appropriate changes of the control electronics, to provide different type fonts, different matrices and different formats.

Additional features of the hammers 24 and the hammer bank should also be appreciated. With reference to FIGS. 3 and 4, for example, the common return member 75, permanent magnet 88 and the insert 90 comprise unitary members for the entire hammer bank. The hammer bank itself is advantageously manufactured by reliable production techniques, as by being constructed as individual frets extending from a common base. The spring hammers are operated well within their elastic limit and therefore have unlimited life. The coils 82 that generate magnetic fields cancelling the permanent magnet fields at the pole tips, thus releasing the hammers, are most efficiently utilized because these coils are disposed adjacent the air gaps. In addition, the tapered pole tips 79 act to concentrate magnetic flux in the region of the hammer, and minimize flux leakage. On retraction of the hammer 24, it tends to curve against the butyl rubber damping element 92, which damps vibration tendencies in the hammer and minimizes cycle time. The damping element 92 may also be tapered or stepped, so as to permit particle matter to descend downwardly without becoming stuck between the damping element 92 and the hammer 24. Any part of this simple hammer bank mechanism may be replaced without requiring readjustment or realignment of the assembly.

Another feature of the shuttle mechanism relates to prestressing of the permanent magnet 88 structure. As best seen in FIG. 4, the base of the shuttle mechanism structure is coupled together by tie bars 120 horizontally spaced along the length of the shuttle mechanism. Preferably, these tie bars 120 are inserted and initially tightened under high temperature, thus unifying and pre-compressing the structure and particularly the permanent magnet 88 when cooled to normal operating conditions. The permanent magnet 88, which is strong in compression but relatively weak under tension, has a greater structural strength as part of the shuttle mechanism. Aluminum tie bars 120 are preferably used for this purpose.

Figure 7:
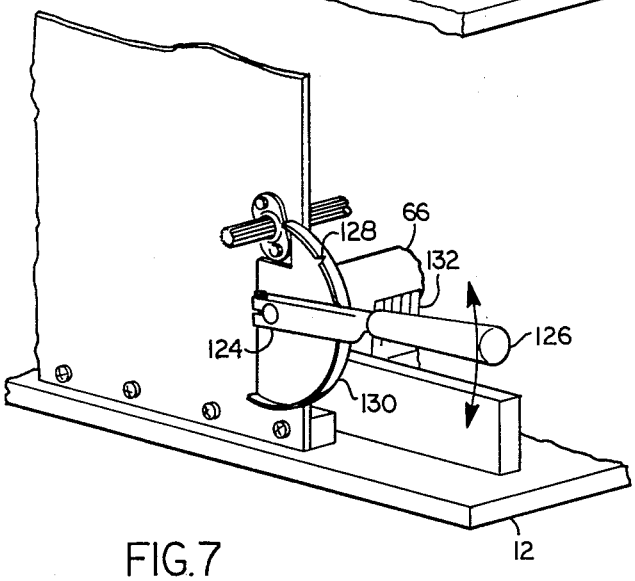
FIG. 7 is a fragmentary perspective view of a portion of a paper thickness adjustment system in accordance with the invention.
Figure 8:
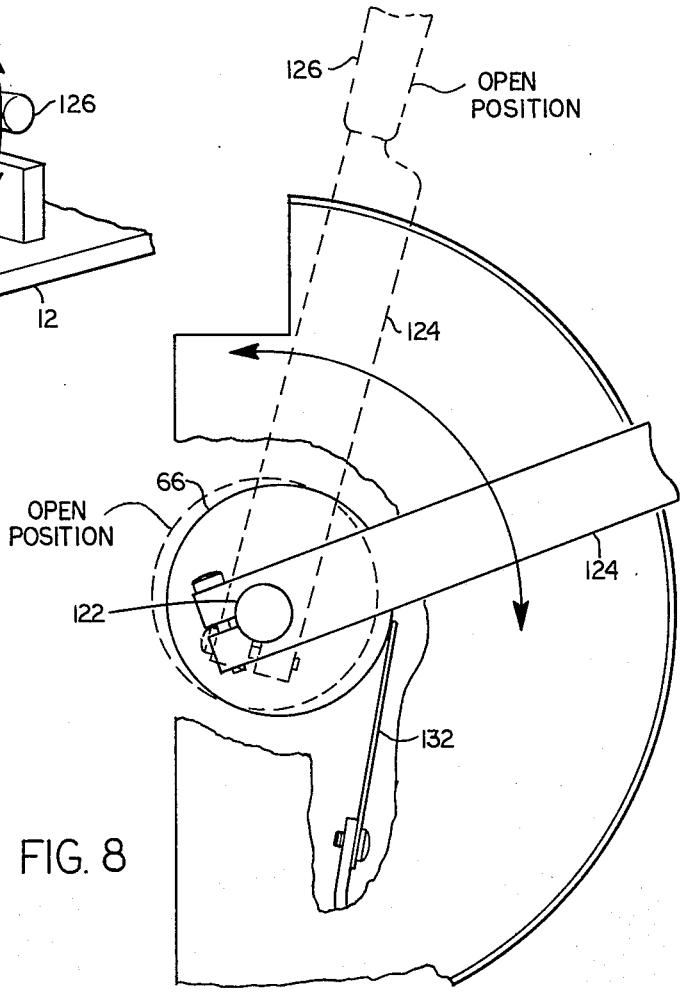
FIG. 8 is a side view of the paper thickness adjustment mechanism of FIG. 7.

Reference is now made to FIGS. 4, 7 and 8, with respect to the paper thickness adjustment control 20 of FIG. 1. The platen 66 extending along the printing line position behind the paper webs 10 is a hardened cylindrical member mounted eccentrically with respect to a shaft 122 journaled in the frame 12. An arm 124 terminating in a handle 126 is coupled to the shaft 122 so as to change the rotational position thereof, the arm 124 being positionable in detent notches 128 in a ring 130 coupled to the frame 12. The surface of the platen moves radially inwardly or outwardly depending upon the handle 126 position, providing a solid backing surface that varies in position relative to the printing plane of the paper, thus compensating for the total thickness of the paper. In addition, a plurality of spring fingers 132 extend upwardly from underneath the printing platen 66, into tangential engagement with the surface of the platen 66 just below the printing line position. Paper is fed up through the adjustable paper control 20 between the spring fingers 132 (also seen in FIGS. 1 and 7), with the platen 66 in the open position, in which the arm 124 is approaching the vertical. The arm 124 is then moved down to a position depending upon the thickness of the paper webs 10. During upward movement of the paper, thereafter, the paper is ironed smooth by the spring fingers, which not only hold the paper flat at the printing line position, but insure that no air bubbles exist under the paper as the shuttle mechanism 22 moves the impacting hammer tips back and forth. This firm positioning and support of the paper in the region of the printing line further insures uniform imprinting through a number of copies, freedom from smearing and from puncturing. These spring fingers 132 also suppress the transmission of printing noise downward due to the vibration of the incoming paper web.

The electronic control system for generating the hammer actuating signals may comprise any of a number of known systems, and therefore is not set forth in detail. The system may comprise, for example, the type of control system used in the printer system described in U.S. Pat. No. 3,782,278, with the encoding wheel providing the positional signals for horizontal dot matrix imprinting. Additionally, dot matrix display techniques are widely used in cathode ray tube displays, and typically incorporate storage for single or multiple lines, with each line of dot patterns for the successive characters being written in sequence during the raster scan until the complete characters are defined. In like fashion, the present system can utilize the same conventional circuits, subdividing them into groups of three and demarcating the dot column positions within the dot matrix in accordance with the timing pulses representative of shuttle mechanism position.

In FIG. 9 there is represented, in block diagram form, the principal elements of an actual exemplification of a system for providing the principal control functions. In conventional data processing fashion, a line of input data, representing 132 characters maximum in this example, is coupled through input decoding circuits 140 into successive character positions in a 132 character buffer 142, which presents the characters to a read only memory system 144, which decodes the individual characters into corresponding dot patterns for each character. These dot patterns are generated serially in accordance with the dot line and dot column counts, as described below, but at any instant only a single actuating signal is provided (or not) to each associated hammer. The dot pattern signals are coupled to hammer driver amplifiers 146, each of which is coupled to a different hammer in the hammer bank. There is one hammer driver amplifier for each of the hammers, and the 132 character patterns that are generated from the read only memory 144 are successively cycled in 44 sets of three by conventional shift register circuits contained within the driver amplifier system 146. One driver amplifier could be used for each character position and switched to be activated for each different character but such an arrangement would be unnecessarily costly and cumbersome for most applications. A power supply 148 is coupled to energize the hammer driver amplifiers 146.

To control the read only memory 144, a column counter 150 and a line counter 152 are each operated by control logic 154 in response to the positional and cycle signals derived by the magnetic pickup 114. In conventional fashion, the encoder wheel 112 may include special indicia, such as a missing tooth, to denote complete cycle times, such as a quarter revolution, as well as the individual teeth or other indicia which provide positional indications for the shuttle mechanism. The special cycle indicia from the magnetic pickup activate the line counter 152, advancing the line counter at the completion of each pass of the shuttle mechanism in one direction or the other. The same cycle signal, appropriately shaped and strobed in the control logic, may be utilized to control the paper feed drive 154 which actuates the paper feed stepping motor 26 so as to advance the paper one dot matrix line. A typical paper sensing circuit 156 may be coupled to the control logic 154 to deactivate the system in the event that the paper supply terminates. The timing signals from the magnetic pickup 114 are applied, after shaping and timing in the control logic 154, to the column counter, to divide the horizontal movement of the shuttle mechanism into accurately demarcated positional increments, the counter 150 being advanced with each timing pulse from the magnetic pickup in one direction and decremented one count for each timing pulse in the other. Thus, for each character position of the character generator read only memory 144, a dot printing impulse is or is not coupled to the hammer driver amplifier 146, depending upon the counts presented by the column and line counters 150, 152 respectively. The timing pulse may be converted to a strobe pulse in conventional fashion, introducing appropriate lead times for hammer flight in each direction of shuttle movement. The control logic 154 also operates the shuttle motor control 158 in on-off fashion dependent upon whether the system is on line to receive data.

While there have been described above and illustrated in the drawings a number of variations, modifications and alternative forms, it will be appreciated that the scope of the invention defined by the appended claims and includes all forms comprehended thereby.

What is claimed is:

1. A mechanical dot matrix printer system comprising:

means for feeding paper incrementally past a printing line position;

a reciprocable hammer bank disposed along said printing line position, each of the hammers including a dot printing means for imprinting a dot when the hammer is impulsed toward the printing line position, said hammer bank being reciprocable along a selected length of printing line;

means coupled to reciprocate said hammer bank bidirectionally with substantially constant velocities in each direction;

a plurality of hammer actuating means disposed adjacent said hammer bank and reciprocating therewith, said hammer actuating means each being associated with a different one of the hammers;

means responsive to input data to be printed for independently actuating said hammers at selected times during motion thereof in each direction of movement; and means coupled to said means for feeding for advancing said paper incrementally during motion reversals of said shuttle mechanism.

2. The system as set forth in claim 1 above, wherein said hammer bank sweeps a selected number of character column positions along the printing line during constant velocity motion, and wherein said hammers are periodically spaced apart by the same number of character positions, such that each hammer imprints a selected number of character columns.

3. The invention as set forth in claim 2 above, wherein each character is printed in a matrix having a selected number of horizontal and vertical dot positions, wherein said means for feeding advances said paper through successive vertical dot positions, and wherein the system further includes encoder means coupled to said reciprocating shuttle means for denoting the horizontal dot increments and providing timing signals to said means for actuating said hammers with appropriate lead times depending on hammer bank direction of movement.

4. The invention as set forth in claim 3 above, wherein said encoder means is coupled to said means to reciprocate said hammer bank, but separate from said hammer bank, and has a motion that is substantially greater than the hammer bank motion, thus to provide a high degree of resolution of the hammer bank motion without increasing the reciprocating means.

5. The system as set forth in claim 4 above, wherein said means for advancing said paper comprises stepping motor means for stepping the paper in the vertical direction by selected incremental distances to define successive vertical dot positions.

6. The system as set forth in claim 5 above, wherein said means coupled to reciprocate said hammer bank operates in accordance with a trapezoidal characteristic, wherein said hammer bank sweeps a selected number of column positions with substantially constant velocity in each of the two directions, and has substantially linear change of velocity in reversing direction.

7. The system as set forth in claim 6 above, wherein said means for reciprocating said hammer bank comprises frame means including spaced apart linear bearing members disposed substantially parallel to the printing line position, hammer bank support shaft means mounted to be linearly movable on said linear bearing members, rotating cam means disposed adjacent said hammer bank, roller cam follower means engaging said cam means and coupled to said hammer bank, and spring means coupled to said hammer bank and biasing said cam follower means toward said cam means such that rotation of said cam means reciprocates said hammer bank.

8. The system as set forth in claim 7 above, wherein said cam means comprises a two lobed cam defining a trapezoidal reciprocating motion, and wherein said system further includes counterweight means disposed on the opposite side of said cam means from said shuttle mechanism, second cam follower means coupled to said counterweight means and engaging said cam means, and second spring means biasing said second cam follower means against said cam means.

9. The system as set forth in claim 8 above, wherein said hammer bank is pivotable about said support shaft means to permit greater clearance for inspection and paper feeding and further including spring means coupling said hammer bank to a spaced apart point of said frame means to hold said hammer bank at a selected limiting pivot position.

10. The system as set forth in claim 9 above, wherein said frame means comprises reference surface means disposed parallel and adjacent to the direction of motion of said hammer bank and said system further includes means coupled to said hammer bank, and engaging the reference surface for defining the limiting pivot position.

11. The system as set forth in claim 7 above, wherein said means for reciprocating said hammer bank includes a drive motor coupled to said cam means, and flywheel means coupled to said drive motor, said encoder means being coupled to said flywheel means.

12. A dot matrix printer for printing characters in character positions on a paper web comprising:

a hammer bank disposed adjacent and transverse to the paper web, the hammers each including dot printer elements and the hammer bank including means for actuating the hammers;

means coupled to said hammer bank for cyclically moving said hammer bank, including said means for actuating the hammers, across a selected number of character positions, said means for cyclically moving including counterweight means for dynamically counterbalancing the mass of said hammer bank and said means for actuating; and means coupled to said actuating means and responsive to the position of said means for cyclically moving for actuating said hammers during movement of said hammer bank.

13. The invention as set forth in claim 12 above, wherein said means for actuating operates said hammers in each direction of movement to define horizontally disposed dots in each line of the character positions, and wherein said printer further includes means engaging said paper web for advancing said paper web by at least one vertical dot position during reversals of said means for cyclically moving said hammer bank.

14. In a printer for printing characters in separate column and row character positions each defined by a pattern of dots in dot matrix column and row positions on a web member, said printer including means for advancing said web members as characters are printed, the improvement comprising:

a shuttle mechanism movable in the row direction;

a plurality of hammers mounted on said shuttle mechanism, each adjacent said web member and each including a dot imprinting means;

a platen disposed on the opposite side of said web member and opposed to said dot imprinting means;

means coupled to said shuttle mechanism for cyclically moving said shuttle mechanism and said hammers bidirectionally along the row direction such that each hammer spans at least one character column position during its travel;

a plurality of magnetic means having a common magnetic member mounted on said shuttle mechanism and movable therewith and each coupled to control a different one of said hammers;

and means for energizing said magnetic means to cause independent imprinting movements of said hammers during travel of said shuttle mechanism in each direction of movement.

15. The invention as set forth in claim 14 above, wherein said system further includes counterweight means coupled to said means for moving said shuttle mechanism for maintaining the system in dynamic balance.

16. The invention as set forth in claim 15 above, wherein said plurality of hammers are periodically disposed along the column direction with center-to-center spacing equal to a selected number of characters greater than one, and wherein said dot imprinting means are in alignment along a printing line position.

17. The invention as set forth in claim 16 above, wherein said means for advancing said web member comprises incremental advance means for moving said web member successively through dot matrix row positions, and wherein said system further includes position indicating means coupled to said means for cyclically moving said shuttle mechanism, said position indicating means providing timing signals to said means for energizing said magnetic means.

18. A print hammer mechanism for a dot matrix printer comprising:

a magnetic resilient print hammer element comprising a single elongated strip having a fixed end and including a dot imprinting element extending in a first direction substantially at the center of percussion from the fixed end thereof;

magnetic circuit means including permanent magnet means coupled in magnetic circuit with said print hammer, said permanent magnet means establishing a magnetic field normally maintaining said print hammer in a spring-loaded retract position;

and means coupled to said magnetic circuit means for substantially cancelling the magnetic field in a portion of said magnetic circuit means adjacent said hammer element to release said hammer element for flight in said first direction with a selected velocity.

19. The invention as set forth in claim 18 above, wherein said means for substantially cancelling the magnetic field comprises electromagnet means and means for applying a unidirectional pulse of selected duration thereto.

20. The invention as set forth in claim 19 above, wherein said means for applying a unidirectional pulse terminates the pulse at impact such that impact absorbs substantially all kinetic energy of said hammer element.

21. The invention as set forth in claim 20 above, wherein said magnetic circuit means includes damping means disposed adjacent the retract position of said hammer element to absorb rebound shock of said hammer element in returning to the retract position.

22. The invention as set forth in claim 20 above, wherein said magnetic circuit means has a generally C-shaped configuration including a return path member and a pair of legs, wherein said print hammer element spans said legs and is fixedly coupled to a base leg thereof while the free end engages the other leg when in the retract position, and wherein said permanent magnet means is disposed as part of said base leg and said damping means is disposed adjacent said permanent magnet means and abuts the hammer element in the retract position.

23. The invention as set forth in claim 22 above, wherein said electromagnet is disposed adjacent the hammer element and about the leg engaging the free end of the hammer element.

24. A dot printing mechanism for a dot matrix printer comprising:

an elongated resilient strip of magnetic material disposed substantially tangential to a printing position adjacent a movable end thereof;

a dot printer head coupled to said resilient strip and extending toward the printing position;

magnetic path means coupled to the end of said strip spaced apart from the printing position and defining a magnetic path including a pole tip adjacent the movable end of the strip;

permanent magnet means disposed adjacent said strip in circuit with said magnetic path means and normally retracting said strip against said pole tip in curved, spring-loaded, position and with the dot printer head disposed in spaced apart position relative to the printing position; and electromagnetic means coupled to said magnetic path means for abruptly removing the magnetic bias on said strip to impel said dot printer head under the spring force of said strip toward the printing position.

25. The invention as set forth in claim 24 above, wherein said magnetic path means includes a generally C-shaped magnetic structure shunting said strip and having a return path member and a pair of extending legs, one of which is fixed to the end of said strip spaced apart from the printing position, and the other of which is adjacent the movable end of said strip, and includes a tapered pole tip to minimize flux leakage.

26. The invention as set forth in claim 25 above, wherein said electromagnetic means is disposed adjacent the end of the leg at the movable end of said strip for maximum efficiency.

27. The invention as set forth in claim 26 above, wherein said resilient strip contains substantially the entire flux of said magnetic path means.

28. The invention as set forth in claim 27 above, wherein said mechanism includes a resilient damping element disposed adjacent the fixed end of said strip and having a face abutting the curved face of said strip in the retract position thereof to damp vibrations in the strip when returning to the retract position.

29. The invention as set forth in claim 28 above, wherein said electromagnet means provides magnetic biasing in the printing direction sufficient to overcome the permanent magnet bias, and wherein said electromagnet means includes means for terminating the magnetic bias in the printing direction substantially at impact of said dot printing head, such that said resilient strip impacts the web with only the kinetic energy imparted by the spring force and is thereafter retracted by the permanent magnet bias.

30. The invention as set forth in claim 29 above, wherein the means for terminating the magnetic bias is adjustable in time to control flight time and impact velocity.

31. A multiple hammer bank for a dot printer comprising:

a plurality of elongated, flat, substantially parallel, magnetic, spring hammer elements disposed in serial fashion along a selected axis in a selected plane and having free ends adjacent a printing line, each hammer including a dot printing element;

magnetic circuit means, including a common magnetic return path member, forming a plurality of substantially complete magnetic paths with said different hammer elements, said magnetic circuit means including a plurality of magnetic pole pieces disposed substantially normal to said selected plane and each in facing relation to the free end of a different hammer element;

means coupled to said magnetic circuit means for magnetically biasing said hammer elements into engagement with its associated pole piece in the absence of a release impulse, to define a spring-loaded retract position;

and means coupled to each of said magnetic circuit means for selectively applying release impulses thereto to momentarily overcome the magnetic bias.

32. The invention as set forth in claim 31 above, wherein said magnetic biasing means comprises permanent magnet means disposed adjacent said return path member, and wherein said release impulse applying means comprises a plurality of coil means, each magnetically coupled to a different one of said pole pieces.

33. The invention as set forth in claim 32 above, wherein said pole pieces include tapered pole tips and wherein said coil means are disposed adjacent said pole tips.

34. The invention as set forth in claim 32 above, wherein said magnetic circuit means comprises a generally C-shaped structure shunting the opposite ends of said hammer elements, the permanent magnet forming at least a part of a base leg of the structure, with the pole pieces forming the other leg and the hammer elements being fixedly coupled to the base leg.

35. The invention as set forth in claim 34 above, wherein said hammer elements comprise a common base and plurality of individual spring elements extending therefrom, and wherein said common base is coupled to the base leg of said C-shaped structure.

36. The invention as set forth in claim 35 above, wherein said base leg also includes magnetic insert means and damping interposed between said permanent magnet means and said hammer elements, said damping means abutting the surfaces of the hammer elements when in the retract position.

37. The invention as set forth in claim 34 above, wherein said hammer bank includes means coupled to the base leg of said C-shaped structure for maintaining the permanent magnet under compression.

38. The invention as set forth in claim 37 above, wherein said compression maintaining means comprises a plurality of tie rod means extending through said base leg.

39. The invention as set forth in claim 32 above, wherein said dot printing elements comprise tips extending normal to said hammer elements at the printing line and said hammer bank further includes planar cover means interposed between said tips and media to be imprinted at the printing line, said cover means including apertures through which the tips extend when the hammers are released.

40. A dot matrix printing system for printing on a web comprising the combination of:

a shuttle mechanism transversely reciprocally movable in a cyclic motion relative to said web;

rotatable cam drive means coupled to said shuttle mechanism to provide the reciprocating motion thereto;

counterweight means substantially equal in mass to said shuttle mechannism and including cam follower means engaging said cam drive means and coupled to move oppositely to said shuttle mechanism;

a plurality of print hammers including dot printing elements mounted on said shuttle mechanism;

means coupled to said print hammers for initiating high velocity movement of said hammers toward said web during transverse motion of said shuttle mechanism; and means for advancing said web along its length in timed relation to the cyclic motion of said shuttle mechanism.

41. The invention as set forth in claim 40 above, wherein said cam drive means provides a trapezoidal velocity characteristic, with substantially constant speed portions in each direction of motion, and wherein said means for initiating movement of said hammers operates during said substantially constant speed portions of movement.

42. The invention as set forth in claim 41 above, wherein said means for initiating movement of said hammers comprises a plurality of magnetic circuit means, each adjacent a different one of said hammers on said shuttle mechanism and movable therewith.

43. The invention as set forth in claim 42 above, wherein said means for initiating movement of said hammers includes means for normally maintaining said hammers in a retract position, wherein said dot printing elements extend from said hammers in a direction substantially normal to said web and lying along a printing line, and wherein said shuttle mechanism includes planar front cover means providing a bearing surface for associated webs and printing ribbons, the front cover means concealing the dot printing elements when in the retract position and including apertures through which the elements imprint.

44. The invention as set forth in claim 43 above, wherein said system prints in successive character columns and rows on the web, each character position being defined by a dot matrix, and wherein the substantially constant speed portion of said shuttle mechanism movement spans a selected number of character columns, said system further comprising position encoder means coupled to said cam means for providing timing pulses denoting separate horizontal dot matrix positions during scanning of the columns.

45. The invention as set forth in claim 44 above, wherein said shuttle mechanism includes an off-axis support shaft mounted for reciprocation of said shuttle mechanism, and is pivotally movable about the axis of said shaft to provide greater clearance relative to said web, and wherein said system includes in addition spring means coupled to said shuttle mechanism for normally biasing said shuttle mechanism to a limiting pivot position adjacent said web.

46. A system for control of the disposition of an arbitrary number of paper webs at the printing line position of a multi-column dot matrix printer comprising:

means disposed below the printing line position for providing a desired number of webs for imprinting;

a cylindrical platen disposed behind the paper and parallel to the printing line position, said cylindrical platen being pivotably mounted at opposite ends adjacent the opposite sides of the paper and along an axis substantially parallel to the printing line position, and having radial eccentricity relative to its rotational axis, said platen being pivotable to a selectable position to define a platen surface for receiving the impact of dot imprinting elements that is substantially normal to the movement of the dot imprinting elements but at variable spacings therefrom dependent on the pivot position thereof;

a plurality of finger elements disposed on the opposite side of said webs from the cylindrical platen, said finger elements being fixedly mounted along a base substantially parallel to the printing line position and the free ends of the finger elements urging said paper webs toward and into engagement with said cylindrical platen;

and means for pivoting said cylindrical platen to thereby change the position of the platen surface relative to the printing line position and said finger elements to provide substantially constant tension independent of total web thickness.

47. The invention as set forth in claim 46 above, wherein said means for pivoting comprises control handle means, and wherein said cylindrical element has an eccentricity of approximately ⅛ inch.

48. The invention as set forth in claim 47 above, wherein said resilient finger elements comprise a plurality of flat strips having relatively small inter-strip spacings and disposed to substantially smooth the selected number of paper webs while substantially eliminating air separations between said webs.

* * * * *